United States Patent [19]

Seko et al.

[11] 4,123,336

[45] Oct. 31, 1978

[54] PROCESS FOR ELECTROLYSIS OF AQUEOUS ALKALI METAL HALIDE SOLUTION

[75] Inventors: Maomi Seko; Yasumichi Yamakoshi, both of Tokyo; Hirotsugu Miyauchi, Kawasaki; Kyoji Kimoto; Yoshinori Masuda, both of Yokohama, all of Japan

[73] Assignee: Asahi Kasei Kogyo Kabushiki Kaisha, Osaka, Japan

[21] Appl. No.: 781,410

[22] Filed: Mar. 25, 1977

[30] Foreign Application Priority Data

Mar. 31, 1976 [JP] Japan ..... 51-35594

[51] Int. Cl.[2] ..... C25B 1/46; C25B 13/08

[52] U.S. Cl. ..... 204/98; 204/296

[58] Field of Search ..... 204/296, 98

[56] References Cited

U.S. PATENT DOCUMENTS

| | | | |
|---|---|---|---|
| 3,909,378 | 9/1975 | Walmsley | 204/98 |
| 3,944,477 | 3/1976 | Argade | 204/266 |
| 3,960,697 | 6/1976 | Kircher et al. | 204/252 |
| 4,024,043 | 5/1977 | Dege et al. | 204/296 |

FOREIGN PATENT DOCUMENTS

| | | | |
|---|---|---|---|
| 2,510,071 | 9/1975 | Fed. Rep. of Germany | 204/296 |

*Primary Examiner*—F.C. Edmundson

*Attorney, Agent, or Firm*—Cooper, Dunham, Clark, Griffin & Moran

[57] ABSTRACT

An aqueous alkali metal halide solution is electrolyzed in an electrolytic cell using a cation exchange membrane which is a fluorocarbon polymer containing sulfonic acid groups and at least one cation exchange group which is less acidic than the sulfonic acid group with higher proportion of the latter in surface stratum on the cathode side of the membrane than in the entire membrane, while controling proton concentration in the anolyte at not higher than critical proton concentration at which no substantial amount of protons in the anolyte penetrate into the membrane.

7 Claims, 3 Drawing Figures

PROCESS FOR ELECTROLYSIS OF AQUEOUS ALKALI METAL HALIDE SOLUTION

This invention relates to a process for electrolysis of an aqueous alkali metal halide solution using a cation exchange membrane comprising a fluorocarbon polymer containing sulfonic acid groups and at least one cation exchange group with weaker acidity than the sulfonic acid group.

It has been known to the art to utilize for electrolysis of aqueous alkali halide solutions, a cation exchange membrane of a perfluorocarbon polymer containing pendant sulfonic acid groups obtained by saponification of a membrane prepared from a copolymer of tetrafluoroethylene and perfluoro-3,6-dioxa-4-methyl-7-octene sulfonyl fluoride. This known perfluorocarbon type cation exchange membrane containing onyl sulfonic acid groups, however, has the disadvantage that the membrane tends to permit penetration therethrough of hydroxyl ions back migrating from the cathode compartment because of the high hydrophilicity of the sulfonic acid groups. As a result, the current efficiency during electrolysis is low. This is a special problem when the electrolysis is used for the production of aqueous solution of caustic soda at concentrations of more than 20 percent. In this reaction, the current efficiency is so low that the process is economically disadvantageous compared with electrolysis of aqueous solutions of sodium chloride by conventional mercury or diaphragm processes.

The disadvantage of such low current efficiency can be alleviated by lowering the exchange capacity of the sulfonic acid group to less than 0.7 milliequivalent per gram of the H form dry resin. Such lowering results in decrease in water content in the membrane, whereby the concentration of fixed ions in the membrane is relatively higher than in a membrane of higher exchange capacity so that the loss of current efficiency during electrolysis is slightly improved. For example, when a caustic soda solution with a concentration of 20% is to be recovered during electrolysis of sodium chloride, the current efficiency can be improved to about 80%. Improvement of current efficiency by decrease of ion exchange capacity of the membrane, however, results in a serious decrease in the electroconductivity of the membrane, so that the method is at an economic disadvantage. Moreover, it is difficult to produce a commercial cation exchange membrane of perfluorosulfonic acid type which can be improved in current efficiency to approximately 90% by increase of membrane resistance.

In order to overcome the drawbacks mentioned above, it has been suggested in U.S. Pat. No. 3,784,399, German Pat. OLS No. 2437395, U.S. Pat. No. 3,969,285 and Japanese Patent Applications No. 84111/1975 and No. 84112/1975 (U.S. Patent Application Ser. No. 701,515) to use cation exchange membranes comprising fluorocarbon polymers containing cation exchange groups with weaker acidity than sulfonic acid on one side of the cation exchange membrane of sulfonic acid type for electrolysis of an aqueous alkali metal halide solution. When electrolysis is carried out by use of such a cation exchange membrane, a high current efficiency can be attained by decrease in water content on the side on which the exchange groups with weaker acidity are present. The thickness of the stratum wherein said groups are present can be as thin as 100 Å or more, which is extremely thin as compared with the entire thickness of the membrane, whereby electric resistance can be made very low so as to achieve a lower cell voltage.

Even in electrolysis by use of such a cation exchange membrane as mentioned above, however, current efficiency is found to be lowered, and there is an increase of voltage when the proton concentration in the anolyte surpasses a certain critical value. In some cases, cleavage or peel-off may occur on a part of the membrane. Said critical value is dependent on various factors such as the temperature, current density, current efficiency, the anolyte concentration, the thickness of the stratum on the cathode side on which the exchange groups with weaker acidity are present, the thickness of desalted layer, etc. It has now been found that these difficulties usually occur at high temperature, current density and current efficiency, which are just the conditions most favorable for commercial practice of the process from the standpoint of decreased fixed charges and proportional costs.

The object of the present invention is to provide a process for electrolysis of an aqueous alkali metal halide solution free from the above problems.

The above object is found to be accomplished by use of a specifically selected cation exchange membrane and by carrying out electrolysis while controlling proton concentration in the anolyte at a value which is not higher than a critical value at which no substantial number of protons will penetrate into the membrane. As a result, electrolysis at a high current efficiency with lower voltage can be effected stably for a long period of time.

The present invention provides a process for electrolysis of an aqueous alkali metal halide solution in an electrolytic cell in which anode and cathode are separated by a cation exchange membrane to divide said cell into anode and cathode chambers, said cation exchange membrane being made of a fluorocarbon polymer containing cation exchange groups consisting of sulfonic acid groups and at least one weaker cation exchange group with weaker acidity than the sulfonic acid group, the cation exchange groups in the surface stratum on the cathode side of the membrane being richer in said weaker cation exchange groups than in the entire membrane, proton concentration in anolyte being maintained at not higher than the critical proton concentration.

The term "critical proton concentration" herein used in the specification and claims refers to the critical value of the concentration of protons in the anolyte at which hydroxyl ions migrating through the cation exchange membrane are neutralized on the interfacial liquid film on the anode side of the membrane so that no substantial amount of protons in the anolyte may penetrate into the membrane, and is generally determined from the equations as set forth below.

The cation exchange membrane used in the present invention comprises a copolymer having the repeating units (I) and (II) as shown below:

$$\text{-}(CF_2\text{—}CXX')\text{-} \qquad (I)$$

$$\text{-}(CF_2CF)\text{-} \qquad (II)$$
$$\quad\;\; | \\ \quad\;\; R$$

wherein X represents F, Cl, H or $—CF_3$; X', F, Cl, H or $—CF_3$; R pendant group containing cation exchange groups. Said copolymer may further contain other units derived from copolymerizable monomers. The membrane contains cation exchange groups as mentioned above in the amount of 900 to 2,000, preferably 1,000 to 1,600, in terms of equivalent weight (grams of dry resin containing one equivalent of ion exchange groups). The ratio of the weaker cation exchange groups based on the total cation exchange groups through the entire membrane is up to 40 mol %, the mol percent being based upon the weight of the whole membrane, preferably up to 20 mol %. The thickness of the membrane to be used in commercial application is from 50 to 500 microns, preferably from 100 to 250 microns.

According to the presently preferred method, the membrane of the invention is prepared by subjecting the membrane containing sulfonic acid groups as cation exchange groups to chemical treatment, especially on the surface thereof, to convert a part of sulfonic acid groups into the weaker cation exchange groups. Details of the methods for production of the membrane used in the present invention, i.e., the membrane containing sulfonic groups as cation exchange groups as mentioned above, are described in, for example, U.S. Pat. Nos. 3,282,875 and 3,718,627 and GB 1,184,321. The subject matter in these patents are incorporated herein by reference.

The cation exchange membrane used in the present invention may have a homogeneous equivalent weight throughout the membrane or alternatively be a composite film consisting of two or more layers with different equivalent weights. In the latter case, the composite consists preferably of two layers with a difference in equivalent weight of 150 or more. The layer with larger equivalent weight is present on the cathode side of the membrane with a thickness of up to ½ of the entire thickness of the composite.

The cation exchange groups with lower acidity than sulfonic acid group may include carboxylic acid groups, phosphoric acid groups, phosphite groups, sulfonamide groups, N-mono-substituted sulfonamide groups, alcoholic or phenolic hydroxyl groups, thiol groups and sulfinic acid groups. Among them, carboxylic acid groups and phosphoric acid groups are preferable from the standpoint of their characteristics and stabilities. In particular, carboxylic acid groups are most preferred.

One example of the cation exchange membranes preferably used in the present invention is the cation exchange membrane comprising a fluorocarbon polymer containing on one side pendant groups R having terminal groups $—OCF_2COOM$ (wherein M is hydrogen, metal or ammonium ion) with the remainder of terminal groups being the groups $—OCF_2CF_2SO_3M$ (M is the same as defined above). This membrane can be produced by treatment with a reducing agent of a membrane containing sulfonyl derivatives such as sulfonyl halide groups, as disclosed by Japanese Patent Applications No. 84111/1975 and 84112/1975, the subject matter of which is herein incorporated be reference.

The proportion of the exchange groups with weaker acidity than sulfonic acid group in surface stratum on the cathode side of the membrane based on the total exchange groups in said stratum may ordinarily fall within the range from 10 to 100 mol %, preferably from 20 to 100 mol %, most preferably from 40 to 100 mol %. The thickness of the stratum, in which the exchange groups with weaker acidity than sulfonic acid group are present, will normally be from 100 Å to 20 microns.

The membranes used in the present invention are desirably reinforced with backings made of nets of polytetrafluoroethylene fibers or porous films of polytetrafluoroethylene, etc. to increase the methanical strength thereof.

The weaker cation exchange groups may be present throughout the entire membrane together with sulfonic acid groups, provided that their proportion increases relative to sulfonic acid groups in the direction towards the surface on the cathode side of the membrane. Further, the weaker exchange groups may also be present on the anode side of the membrane in lower proportion than in the surface stratum on the cathode side of the membrane. Practically, however, to practice commercial electrolysis while using less electric power, it is sufficient and advantageous to have the weaker cation exchange groups present substantially in a surface stratum with a thickness of 100 Å to 20 microns only on the cathode side of the membrane, with the cation exchange groups in residual portion, especially on the anode side of the membrane, being mostly sulfonic acid groups.

According to the present invention, it is also required to maintain proton concentration in the anolyte at not higher than the critical proton concentration as mentioned above, thereby to maintain a high current efficiency and prevent increase in voltage, and also to prevent the stratum with higher proportion of the weaker cation exchange groups on the cathode side of the membrane from being peeled away from the membrane. By this method, the membrane life can be prolonged to a great extent to make possible stable running periods of long duration.

The principle of the invention is illustrated by referring to the accompanying drawings, in which.

Figure 1:
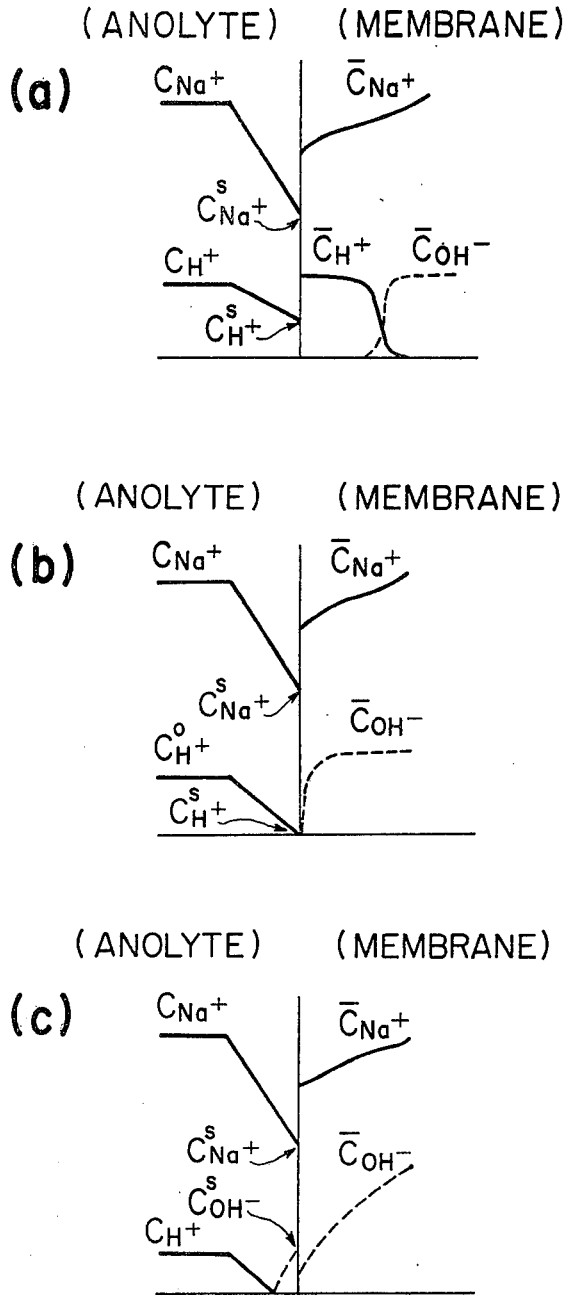
FIG. 1 shows schematic diagrams indicating the positions at which neutralization will occur.

Referring now to FIG. 1, electrolysis of sodium chloride is further illustrated. When hydroxyl ions migrating through the cation exchange membrane are neutralized with protons in the anolyte, neutralization can occur at three possible positions as represented in FIG. 1 by the three cases (*a*), (*b*) and (*c*). In FIG. 1 (*a*), neutralization occurs in the membrane; in FIG. 1 (*b*), at interfacial liquid film on the membrane; and in FIG. 1 (*c*), outside the membrane. The relations between symbols in FIG. 1 are as follows according to Donnan's membrane equilibrium:

$$C_{Na^+}{}^s < \overline{C}_{Na^+},\ C_{H^+}{}^s < \overline{C}_{H^+} \text{ and } C_{OH^-}{}^s > \overline{C}_{OH^-}$$

wherein $C_{Na}$ represents the concentration of the ion Na in the anolyte; $C_{Na}{}^s$ the concentration of the ion Na at the interfacial liquid film; and $\overline{C}_{Na}$ the concentration of the ion Na in the membrane.

Which one of the above cases (*a*), (*b*) and (*c*) will occur is determined by various factors such as the temperature, the current density, the current efficiency, the concentration of anolyte, the proton concentration in the anolyte, the thickness of the desalted layer, etc. Therefore, it cannot be determined in general terms. Generally speaking, however, the case (*a*) is liable to occur with higher current efficiency, as the anolyte concentration is lower, as the proton concentration in the anolyte is higher, or as the thickness of desalted layer decreases. The influences of the temperature and the current density are very complicated because they are closely related to the temperature change of diffusion coefficient of ions or the changes in thickness of the desalted layer. When these parameters are high, the case (*a*) is also liable to occur.

As described above, when the proton concentration in the anolyte exceeds the critical proton concentration which is dependent on various factors such as the temperature, the current density, the current efficiency, the anolyte concentration, the thickness of the stratum on the cathode side wherein the exchange groups with weaker acidity than sulfonic acid group exist, the thickness of the desalted layer, etc., the position at which neutralization occurs in the case (*a*) shifts toward the cathode side until substantial amount of protons reach the surface of the cathode side of the membrane. As a result, a part of the groups with relatively weaker acidity contained in the surface stratum are converted to H form, whereby said groups cannot be dissociated to decrease the current efficiency and increase the voltage. The swelling ratio in the portion converted to H form differs from other portions to cause cleavage in the membrane until peel-off of the surface stratum may occur in the presence of vigorously migrating hydrated sodium ions.

According to the process of the present invention, hydrochloric acid is added to the anolyte to control the concentration of protons in the anolyte at the inlet into the anode chamber so that it is maintained at not higher than the critical proton concentration. As a result, the hydroxyl ions migrating through the membrane are neutralized on the interfacial liquid film on the anode side of the membrane or at a position even nearer than said film to the anode to prevent the surface stratum on the cathode side of the membrane from contact with substantial numbers of protons. Thus, a high current efficiency can be maintained and elevation of the voltage can be avoided without peel-off of the surface stratum on the cathode side of the membrane, whereby stable running can be made possible for long periods of time.

The upper limit of the proton concentration in the anolyte (critical proton concentration) should be selected in the range as specified above and the proton concentration is controlled according to the method as detailed below.

In the case (*b*) as mentioned above, from the mass balance of protons at the interfacial liquid film, equation (1) is obtained since $C_{H^+}{}^s = O$:

$$(i/F)(l - y) = (i/F)t_{H^+} + C_{H^+}{}^o(D_{H^+}/d). \quad (1)$$

wherein the symbols have the following meanings:

$(i/F)t_{H^+}$: protons carried by current through the anolyte;

$C_{H^+}{}^o(D_{H^+}/d)$: protons carried by diffusion through desalted layer;

$(i/F)(l - y)$: hydroxyl ions migrated through the membrane;

*i*: Current density ($A/dm^2$);

F: Faraday constant, 96500 (coulomb/eq.);

*d*: thickness of desalted layer (cm);

*y*: transport number of sodium ions through the membrane; and $D_{H^+}$: diffusion coefficient of protons in the anolyte ($cm^2 \cdot sec^{-1}$)

The transport number $t_{H^+}$ of the protons in the anolyte is represented approximately by the equation (2):

$$t_{H^+} = \frac{D_{H^+}}{(D_{H^+} + D_{Cl^-}) + (C_{Na^+}/C_{H^+})(D_{Na^+} + D_{Cl^-})} \quad (2)$$

wherein $D_{Na^+}$ and $D_{Cl^-}$ represent diffusion coefficients of sodium ions and chlorine ions in the anolyte, respectively.

From the equation (1), the critical proton concentration is represented by the following formula:

$$C_{H^+}{}^o = (id/FD_{H^+})(l - y - t_{H^+}). \quad (3)$$

Thus, the critical concentration $C_{H^+}{}^o$ can be determined by solving the simultaneous equations (2) and (3).

In the equation (3), when the value of *i* is made larger, vigorous generation of gases occurs. As a result, the value of *d* is decreased, whereby $C_{H^+}{}^o$ is rendered rather smaller in many cases.

As will be seen from the above description, when the proton concentration is gradually increased while keeping other conditions constant, there is little change in both current efficiency and the voltage of the membrane. When the concentration exceeds the critical value $C_{H^+}{}^o$, however, *y* is lowered with increase of the voltage and peel-off of the surface stratum. Accordingly, the value *y* to be applied in the equation (3) should be selected within the values at a sufficiently low proton concentration, whereby no such trouble occurs.

Figure 2:
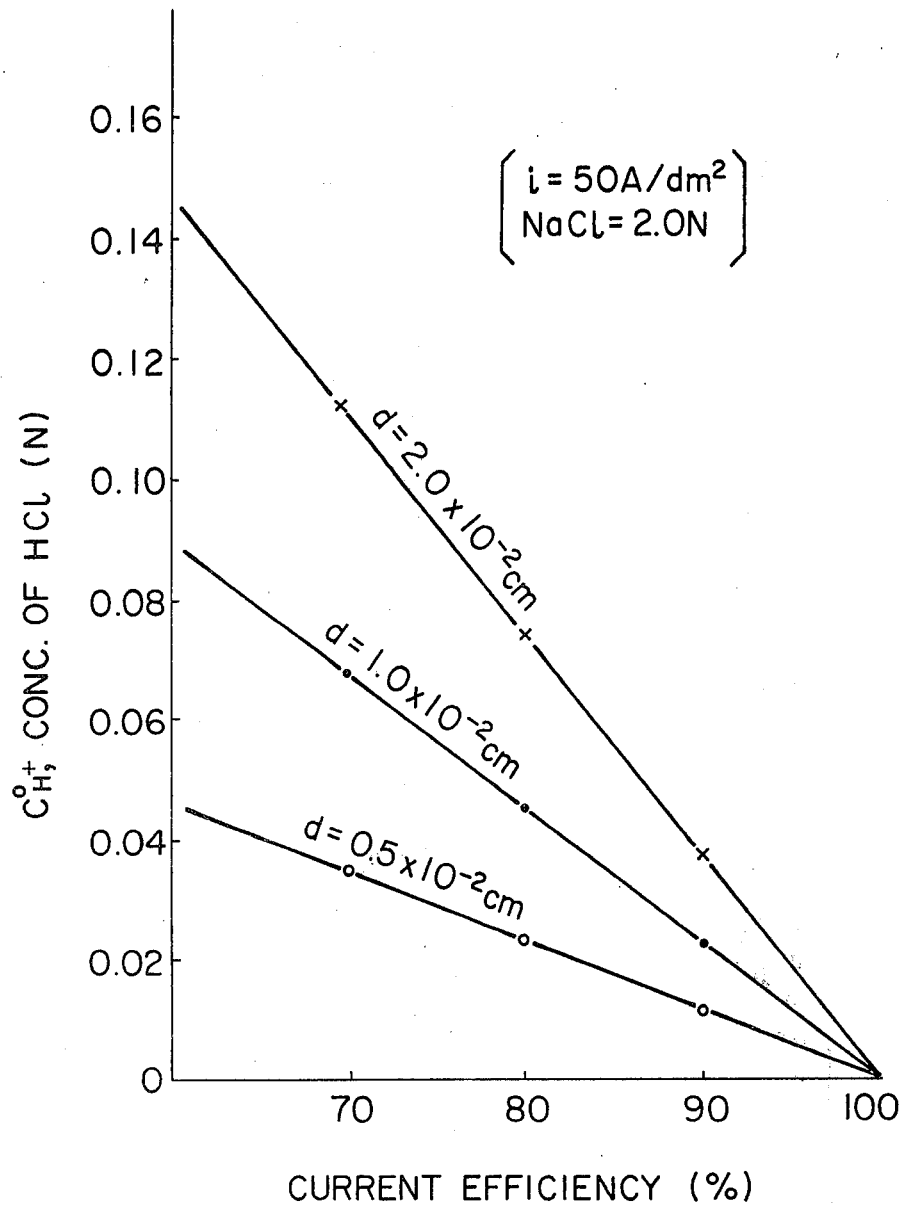
FIG. 2 and FIG. 3 are both graphical representations of the value $C_{H^+}{}^o$ as defined below versus current efficiency (which is represented in terms of percentage corresponding to transport number of sodium ions through the membrane).
Figure 3:
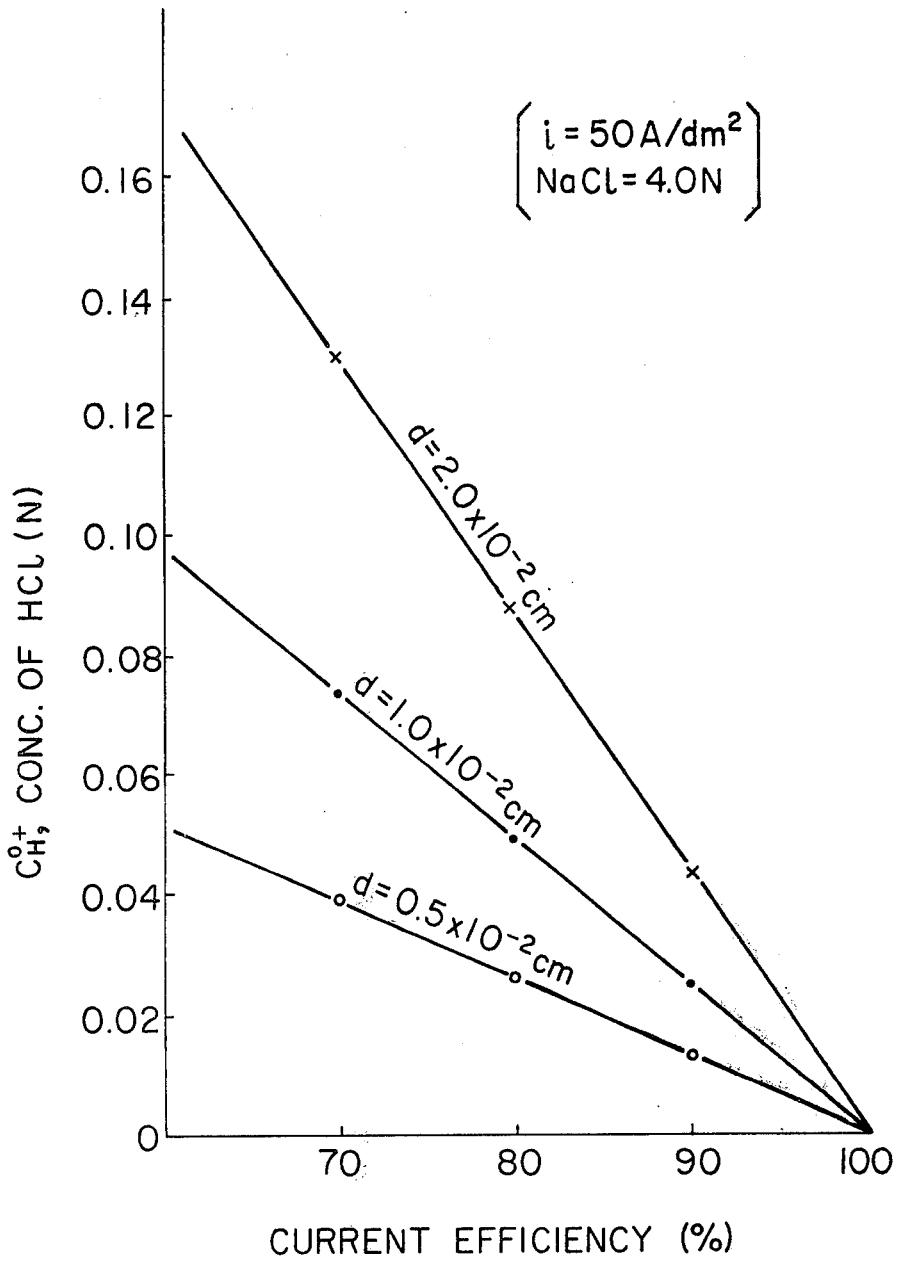

FIG. 2 and FIG. 3 show the results of calculations for $C_{H^+}{}^o$ with the values of *d* as parameter in cases of the anolyte concentrations of 2.0 N and 4.0 N, respectively, at 90° C. and a current density of 50 $A/dm^2$. The diffusion coefficients of each in the liquid are determined by the conventional method from equivalent conductivity at 90° C. at infinite dilution, and are as follows:

$D_{H^+}$: $19 \times 10^{-5}$ ($cm^2 \cdot sec^{-1}$)

$D_{Na^+}$: $4.1 \times 10^{-5}$ ($cm^2 \cdot sec^{-1}$)

$D_{Cl^-}$: $6.0 \times 10^{-5}$ ($cm^2 \cdot sec^{-1}$)

From the results of measurements of the thickness of the desalted layer by conventional methods which determine the limiting current density by varying $i/C_{Na^+}$, the thickness of desalted layer is, under ordinary practical electrolysis conditions, generally in the range from about $0.1 \times 10^{-2}$ to $4 \times 10^{-2}$ cm, preferably from about $0.5 \times 10^{-2}$ to $2 \times 10^{-2}$ cm. The values as indicated in the Table below can be read from $C_{H^+}{}^o$ from FIGS. 2 and 3 in the combination of the current efficiency and the anolyte concentration:

| Current efficiency | Salt conc. = 2.0 N | Salt conc. = 4.0 N |
|---|---|---|
| 80 % | 0.074 - 0.024 N | 0.087 - 0.026 N |
| 85 % | 0.056 - 0.019 N | 0.066 - 0.019 N |
| 90 % | 0.039 - 0.012 N | 0.044 - 0.013 N |
| 95 % | 0.020 - 0.006 N | 0.023 - 0.006 N |

As mentioned above, according to the process of this invention, there is selected for the critical proton concentration the value of $C_{H^+}{}^o$ which is determined by the temperature, the concentration of sodium chloride, the current density, the current efficiency and the thickness of desalted layer under the electrolysis conditions. Accordingly, the hydroxyl ions migrating into the anode side through the membrane are neutralized on the interfacial liquid film on the surface on the anode side of the membrane or at a position nearer than said film to the anode, whereby substantial amounts of protons are prevented effectively from contact with the surface stratum on the cathode side of the membrane to result in a high current efficiency with stability, and without voltage elevation and peel-off of said surface stratum.

The lower limit of the proton concentration in the anolyte is determined to protect the metal electrodes and to surpress the oxygen concentration in the chlorine gas generated in the anode chamber under a selected value which is generally $1.0 \times 10^{-5}$ N. From these standpoints, the proton concentration is preferably as high as possible and therefore it is desirable and industrially advantageous to know the upper limit thereof (critical proton concentration) and operate electrolysis while controlling the proton concentration in the vicinity of the critical value.

Electrolysis of the present invention is carried out in practical application at a temperature of 60° to 130° C., a current density of 10 to 80 A/dm$^2$, an anolyte concentration of 1 to 5 N and the catholyte concentration of 1 to 20 N. The anode and cathode to be used are not limited in material or type, but anode is made desirably of a dimensionally stable metal.

The following non-limiting examples are for illustration only.

EXAMPLE 1

Tetrafluoroethylene and perfluoro(3,6-dioxa-4-methyl-7-octene sulfonyl fluoride) were copolymerized in an emulsion in the presence of ammonium persulfate as the initiator and ammonium perfluorooctoate as the emulsifier at 70° C. under the pressure of 4 atmospheres of tetrafluoroethylene.

The exchange capacity of the resultant polymer, when measured after washing with water and saponification, was 0.83 milligram equivalent/gram of dry resin.

This copolymer was molded with heating into a film of 0.3 mm in thickness. It was then saponified in a mixture of 2.5 N caustic soda/50 percent methanol at 60° C. for 16 hours, converted to the H form in 1 N hydrochloric acid at 90° C. for 16 hours, and heated at 120° C. under reflux for 40 hours in a 1:1 mixture of phosphorus pentachloride and phosphorus oxychloride to be converted into the sulfonyl chloride form. At the end of the reaction, the copolymer membrane was washed under reflux with carbon tetrachloride for 4 hours at 40° C. and then measured for attenuated total reflection spectrum (hereinafter referred to as A.T.R.), which showed a strong absorption band at 1420 cm$^{-1}$ characteristic of sulfonyl chloride but no absorption of sulfonic acid group at 1060 cm$^{-1}$. In a crystal violet solution, the membrane was not stained.

Between frames made of acrylic resin, two sheets of this membrane were fastened in position by means of packings made of polytetrafluoroethylene. The frames were immersed in an aqueous 57 percent hydroiodic acid solution so that one surface of each membrane would undergo reaction at 80° C. for 30 hours. After washing with water at 60° C. for 30 minutes, the treated surface of the membrane was subjected to measurement of A.T.R. In the spectrum, the absorption band at 1420 cm$^{-1}$ characteristic of sulfonyl chloride group vanished and an absorption band at 1780 cm$^{-1}$ characteristic of carboxylic acid group appeared instead. In a crystal violet solution, a layer of about 25 microns on one surface of the membrane was stained.

This membrane was saponified in a mixture of 2.5 N caustic soda/50% aqueous methanolic solution at 60° C. for 16 hours and the treated surface was again subjected to measurement of A.T.R., whereby the absorption of carboxylic acid group was found to be shifted to 1690 cm$^{-1}$. The specific conductivity of this membrane, when measured in 0.1 N aqueous caustic soda solution after being treated with oxidizing agent in a mixture of 2.5 N caustic soda/2.5% aqueous sodium hypochlorite solution at 90° C. for 16 hours, was $10.0 \times 10^{-3}$ mho/cm. The membrane was stained again after the above treatment with oxidizing agent. From observation of the cross-section stained, the thickness of the surface stratum containing carboxylic acid groups was found to be 7 microns.

The specific conductivity of the membrane was determined by initial conversion to a complete Na form, keeping the membrane in a constantly renewed bath of an aqueous 0.1 N caustic soda solution at normal temperature for ten hours until equilibrium and subjecting it to an alternating current of 1000 cycles while under an aqueous 0.1 N caustic soda solution at 25° C. for measurement of the electric resistance of the membrane.

The aforementioned Na form cation exchange membrane was equilibrated in an aqueous 5.0 N caustic soda solution at 90° C. for 16 hours, incorporated in an electrolytic cell having a dimensionally stable metal electrode as an anode and an iron plate as the cathode in such a way that the treated surface fell on the cathode side.

While the concentration of sodium chloride on the anode side was kept at 4 N and the alkali concentration on the cathode side at 8 N in the absence of hydrochloric acid added in the anolyte, current was passed at 90° C. at a current density of 50 A/dm$^2$ for 5 hours. The current efficiency determined from the amount of sodium hydroxide formed was 91% with voltage of 3.7 volt. The thickness of the desalted layer, measured by the method described above, was $1 \times 10^{-2}$ cm. From FIG. 3, the value $C_{H^+}{}^{o}$ corresponding to $d = 1 \times 10^{-2}$ cm and current efficiency = 91% was found to be 0.022 N.

Electrolysis was continued under the same conditions described above except that the proton concentration in the anolyte was maintained by addition of 0.013 N HCl which is lower than the critical value as determined above. During passage of current, which continued for 300 hours, the current efficiency was found to be stable at 91% at a voltage of 3.7 volts. At the end of this period, the membrane was taken out and inspected by microscope. No unusual changes in the membrane were observed.

EXAMPLE 2

Current was passed for 200 hours under the same conditions as in Example 1 except that the proton concentration was changed to 0.02 N.

The current efficiency was stable at 90 to 91% at a voltage of 3.7 volt. Nothing unusual was observed in the membrane after passage of the current.

COMPARISON EXAMPLE 1

Current was passed under the same conditions as in Example 1 except that the proton concentration in the anolyte was changed to 0.10 N.

The current efficiency varied appreciably in the range from 82 to 87% at a voltage of 4.2 to 4.3 volt.

After passage of current, the membrane was removed to observe the surface and a cross-section. Peel-off of the thin layer at several portions on the cathode side of the membrane was observed.

EXAMPLE 3

Utilizing the same polymerization method as described in Example 1, there were prepared copolymers having exchange capacities of 0.74 milligram equivalent/gram dry resin (referred to hereinafter as Polymer 1) and 0.91 milligram equivalent/gram dry resin (referred to hereinafter as Polymer 2), respectively.

Polymers 1 and 2 in the form of sulfonyl-fluoride were molded into films of 2 mils and 4 mils in thickness, respectively, and both of the films were combined with heating into a composite film. The composite film was superposed, with the surface of the Polymer 2 facing downwardly, on a "leno-woven" fabric with thickness of about 0.15 mm made of polytetrafluoroethylene with filling yarns of 400 denier multi-filaments and warp yarns of 200 denier multi-filaments, the numbers of both filling and warp yarns being 25/inch. The fabric was thus embedded in Polymer 2 by heating at 270° C. while pressing the membrane against the fabric under vacuum.

This membrane was converted to the form of sulfonylchloride by the same method used in Example 1, then treated on the side of the Polymer 1 with 57% aqueous hydroiodic solution at 80° C. for 20 hours, followed by saponification and oxidation to obtain a cation exchange membrane having surface stratum containing carboxylic acid groups with 8 microns of thickness on the side of Polymer 1.

The thickness of desalted layer at this time was measured by the same method as in Example 1. It was $d=0.9 \times 10^{-2}$ cm. From FIG. 3, the value $C_{H^+}{}^o$ corresponding to $d=0.9 \times 10^{-2}$ cm and current efficiency=95%, was found to be 0.012 N.

When current was passed for 300 hours, with the surface stratum containing carboxyl groups facing the cathode side, at 90° C. at a current density of 50 A/dm$^2$, under the conditions of 4 N sodium chloride concentration and 0.01 N proton concentration (lower than the critical value), and 8 N alkali concentration on the cathode side, the current efficiency was 95% at a voltage of 3.8 volt. After passage of current, the membrane was removed for observation. No unusual changes had taken place.

COMPARISON EXAMPLE 2

Current was passed for 300 hours using a membrane prepared as in Example 3 under the same conditions as in Example 3 except that the proton concentration was changed to 0.08 N. The current efficiency was 87% at a voltage of 4.4 V. When the cross-section of the membrane was observed after passage of the current, the surface stratum on the cathode side of the membrane was found to have undergone peel-off.

EXAMPLE 4

There was used a membrane having a surface stratum of 5 microns in thickness containing phosphoric acid groups with the residual portion containing sulfonic acid groups.

The thickness of the desalted layer was measured by the same method employed in Example 1. It was $d=1.0 \times 10^{-2}$ cm. The value of $C_{H^+}{}^o$ on FIG. 3 corresponding to $d=1.0 \times 10^{-2}$ cm and current efficiency=90% was found to be 0.025 N.

With the side containing phosphoric acid groups facing the cathode side, current was passed for 200 hours under the same conditions as in Example 1. The current efficiency was stable at 90% at a voltage of 3.7 volt. Nothing unusual was observed in the membrane after passage of the current.

COMPARISON EXAMPLE 3

Current was passed for 200 hours under the same conditions as in Example 4 except that the proton concentration was changed to 0.05 N. The current efficiency was found to be 83% at a voltage of 4.1 volts. The surface stratum containing phosphoric acid groups of the membrane after current passage was observed to have partially undergone peel-off.

EXAMPLE 5

Example 4 was repeated except that a membrane containing carboxylic acid groups in addition to phosphoric acid groups was used. Similar results were obtained.

COMPARISON EXAMPLE 4

A membrane with cation exchange groups in the form of sulfonylfluoride as obtained in Example 1 was saponified in 2.5 N-NaOH/50% methanol solution to convert the fluoride groups to sulfonic acid groups.

When electrolysis was carried out under the same conditions as in Example 1, the current efficiency was found to be 60% at a voltage of 3.4 V. Nothing unusual was observed in the membrane after current passage continued for 300 hours.

When electrolysis was carried out under the same conditions described above except that the proton concentration in the anolyte was changed to 0.10 N, a similar result was obtained.

What we claim is:

1. A process for electrolysis of a sodium chloride solution in an electrolytic cell in which anode and cathode are separated by a cation exchange membrane to divide said cell into anode and cathode chambers, said cation exchange membrane comprising at least one fluorocarbon polymer which contains sulfonic acid cation exchange groups and at least one cation exchange group with weaker acidity than sulfonic acid group, the cation exchange groups in surface stratum on the cathode side of the membrane being richer in said weaker cation exchange group than the balance of the membrane, the proton concentration in the anolyte being maintained at a value up to the critical proton concentration $C_{H^+}{}^o$ as defined by the following formula:

$$C_{H^+}{}^o = (id/FD_{H^+})\,(l - y - t_{H^+})$$

wherein $i$ represents current density (A/dm$^2$), F the Faraday constant: 96,500 coulomb/eq., $d$ the thickness of the desalted layer (cm), $y$ the transport number of sodium ions through the membrane, $D_{H^+}$ the diffusion coefficient of protons in the anolyte (cm$^2$·sec$^{-1}$), and $t_{H^+}$ the transport number of the protons in the anolyte of the formula:

$$t_{H^+} = \frac{D_{H^+}}{(D_{H^+} + D_{Cl^-}) + (C_{Na^+}/C^o_{H^+})(D_{Na^+} + D_{Cl^-})}$$

wherein $D_{Na^+}$ and $D_{Cl^-}$ represent diffusion coefficients of sodium ions and chlorine ions in the anolyte, respectively, and $C_{Na^+}$ concentration (N) of sodium ions in the anolyte, respectively.

2. A process as in claim 1, wherein the weaker cation exchange group is at least one member selected from the group consisting of carboxylic acid and phosphoric acid groups.

3. A process as in claim 2, wherein the weaker cation exchange group is a carboxylic acid group.

4. A process as in claim 3, wherein the carboxylic acid is represented by the formula $—OCF_2COOM$ and the sulfonic acid group is represented by the formula $—OCF_2CF_2SO_3M$ wherein M is a hydrogen, metal or ammonium ion.

5. A process as in claim 1, wherein the cation exchange groups in the surface stratum on the cathode side of the membrane consists substantially of the weaker cation exchange groups and those other than in said stratum consist substantially of sulfonic acid groups.

6. A process as in claim 5, wherein the thickness of the surface stratum is from 100 Å to 20 microns.

7. A process as in claim 1, wherein the cation exchange membrane is a composite consisting of two layers having different equivalent weights with a difference of at least 150, the layer with larger equivalent weight being on the cathode side of the membrane and having a thickness up to ½ of the entire thickness of the composite.

* * * * *